US007629988B2

(12) United States Patent
Chung et al.

(10) Patent No.: US 7,629,988 B2
(45) Date of Patent: Dec. 8, 2009

(54) METHOD AND APPARATUS FOR DRIVING LIQUID CRYSTAL DISPLAY

(75) Inventors: In Jae Chung, Kyounggi-do (KR); Eui Yeol Oh, Kyounggi-do (KR); Ki Duk Kim, Kyounggi-do (KR)

(73) Assignee: LG Display Co., Ltd., Seoul (KR)

( * ) Notice: Subject to any disclaimer, the term of this patent is extended or adjusted under 35 U.S.C. 154(b) by 558 days.

(21) Appl. No.: 10/878,402

(22) Filed: Jun. 29, 2004

(65) Prior Publication Data

US 2005/0140636 A1 Jun. 30, 2005

(30) Foreign Application Priority Data

Dec. 29, 2003 (KR) ..... 10-2003-0099235

(51) Int. Cl.
*G09G 5/02* (2006.01)

(52) U.S. Cl. ..... 345/694; 345/102

(58) Field of Classification Search ..... 345/95, 345/88, 102, 87, 694
See application file for complete search history.

(56) References Cited

U.S. PATENT DOCUMENTS 5,143,433 A * 9/1992 Farrell ..... 362/29
5,929,843 A * 7/1999 Tanioka ..... 345/600
2001/0050661 A1 * 12/2001 Noda et al. ..... 345/32

FOREIGN PATENT DOCUMENTS

| | | |
|---|---|---|
| JP | 01-259396 | 10/1989 |
| JP | 02-245733 | 10/1990 |
| JP | 03-109525 | 5/1991 |
| JP | 04-355722 | 12/1992 |
| JP | 08-095044 | 4/1996 |
| JP | 11-295717 | 10/1999 |

* cited by examiner

*Primary Examiner*—Amr Awad
*Assistant Examiner*—Yong Sim
(74) *Attorney, Agent, or Firm*—Morgan Lewis & Bockius LLP

(57) ABSTRACT

A method of driving a liquid crystal display including a color filter array having a plurality of red, green, blue and white color filters includes applying first driving signals to first liquid crystal cells during one frame interval, the first liquid crystal cells being overlapped by the red, green and blue color filters, respectively, applying a second driving signal to a second liquid crystal cell during a partial period of the one frame interval, the second liquid crystal cell being overlapped by the white color filter, and applying a third driving signal different from the second driving signal to the second liquid crystal cell during a remaining period of the one frame interval.

7 Claims, 14 Drawing Sheets

METHOD AND APPARATUS FOR DRIVING LIQUID CRYSTAL DISPLAY

This application claims the benefit of Korean Patent Application No. P2003-99235 filed in Korea on Dec. 29, 2003, which is hereby incorporated by reference.

BACKGROUND OF THE INVENTION

1. Field of the Invention

This invention relates to a liquid crystal display, and more particularly to a driving method and apparatus for a liquid crystal display including red, green, blue and white color filters.

2. Description of the Related Art

Generally, a liquid crystal display (LCD) controls light transmittance of liquid crystal cells using an electric field to thereby display a picture. To this end, the LCD includes a liquid crystal display panel having a pixel matrix, and a driving circuit for driving the liquid crystal display panel. The driving circuit drives the pixel matrix such that picture information is displayed on a display panel.

FIG. 1 schematically shows a related art LCD. Referring to FIG. 1, the related art LCD includes a liquid crystal display panel 2, a data driver 4 for driving data lines DL1 to DLm of the liquid crystal display panel 2, a gate driver 6 for driving gate lines GL1 to GLn of the liquid crystal display panel 2, and a timing controller 8 for controlling a driving timing of the data and gate drivers 4 and 6. The timing controller 8 receives a dot clock DCLK, a horizontal synchronizing signal Hsync, a vertical synchronizing signal Vsync, a data enable signal DE and data. The timing controller 8 re-arranges the received data and applies the rearranged data to the data driver 4. Further, the timing controller 8 generates timing signals for controlling the timing of the data driver 4 and the gate driver 6 and control signals such as a polarity inversion signal.

The gate driver 6 sequentially applies a gate signal to the gate lines GL1 to GLn in response to a control signal from the timing controller 8. The data driver 4 converts R, G and B data from the timing controller 8 into analog data signals to thereby apply data signals for each one horizontal line to the data lines DL1 to DLm during each horizontal period when the gate signal is supplied to the gate lines GL1 to GLn.

The liquid crystal display panel 2 includes thin film transistors TFT and liquid crystal cells. The thin film transistors TFT are provided adjacent to crossings of an n number of gate lines GL1 to GLn and an m number of data lines DL1 to DLm. The liquid crystal cells are connected to the thin film transistors TFT and have a matrix structure.

Each thin film transistor TFT applies a data from one of the data lines DL1 to DLm to a liquid crystal cell in response to a gate signal from one of the gate lines GL1 to GLn. The liquid crystal cell comprises a common electrode and a pixel electrode. The pixel electrode is connected to the thin film transistor TFT. The common electrode is opposite the pixel electrode. A liquid crystal material is disposed between the common electrode and the pixel electrode. Thus, the liquid crystal cell can be equivalently expressed as a liquid crystal capacitor Clc. Such a liquid crystal cell is provided with a storage capacitor Cst connected to the pre-stage gate line in order to store a data voltage charged in the liquid crystal capacitor Clc until the next data voltage is charged therein.

FIG. 2 is a detailed perspective view of the liquid crystal display panel shown in FIG. 1. As shown in FIG. 2, the liquid crystal display panel 2 comprises a color filter array substrate 24 and a thin film transistor array substrate 26 joined to each other and having a liquid crystal 18 therebetween. The liquid crystal 18 rotates in response to an electric field applied thereto, thereby controlling a transmitted amount of an input light, through the thin film transistor array substrate 26, from a back light (not shown).

FIG. 3 depicts the color filter array shown in FIG. 1. The color filter array substrate includes a color filter array 14, a black matrix 12 and a common electrode 16 that are provided at the rear side of an upper substrate 11. As shown in FIG. 3, the color filter array 14 comprises red (R), green (G) and blue (B) color filters. Such red (R), green (G) and blue (B) color filters transmit light within a specific band of wavelengths to thereby display color images. The black matrix 12 is provided between the adjacent color filters R, G and B to absorb a light emitted from adjacent cells. In other words, the black matrix 12 absorbs light emitted from the adjacent cells to prevent contrast degradation.

The thin film transistor array substrate 26 shown in FIG. 2 includes a pixel electrode 20. The pixel electrode 20 is provided at the front side of a lower substrate 22 and is connected to the thin film transistor TFT provided adjacent to a crossing of a data line DL and a gate line GL. The pixel electrode 20 can be made of a transparent conductive material having a high light transmittance. Such a pixel electrode 20 generates a potential difference with respect to the common electrode 16 when a data signal is applied through the thin film transistor TFT, thereby rotating the liquid crystal 18 in a desired direction. Then, a desired light propagating through the liquid crystal 18 is emitted through the R, G and B color filters provided for each liquid crystal cell Clc, thereby displaying a desired picture.

FIG. 4 represents a driving process of the liquid crystal cell shown in FIG. 1. First, a data signal is applied to each liquid crystal cell Clc during one frame interval 1F. Then, the liquid crystal 18 of each liquid crystal cell Clc is rotated in response to the data signal. A light supplied by an external back light (for example, a cold cathode fluorescent lamp (CCFL)) is controlled by the liquid crystal cell Clc (i.e., in response to a rotation of the liquid crystal cell 18) and transmitted to the color filter array 14. Thereafter, a light supplied through the liquid crystal cell Clc is converted into colored light by the red (R), green (G) and blue (B) color filters, thereby displaying a desired color picture.

The related art LCD has the following drawbacks. The color filter array 14 includes only three initial color (R, G and B) filters, which limits the display of vivid colors. Also, the related art red (R), green (G) and blue (B) color filters have a transmittance less than 50%, which makes achieving high brightness difficult.

SUMMARY OF THE INVENTION

Accordingly, the present invention is directed to a method and apparatus for driving liquid crystal display that substantially obviate one or more of the problems due to limitations and disadvantages of the related art.

An object of the present invention to provide a method for driving a liquid crystal display having vivid colors ratio and improved brightness.

Another object of the present invention to provide an apparatus for driving a liquid crystal display having vivid colors ratio and improved brightness.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages, and in accordance with the purpose of the present invention, as embodied and broadly described, the method of driving a liquid crystal display, which includes a color filter array having a plurality of red, green, blue and white color filters, includes applying first driving signals to first liquid crystal cells during one frame interval, the first liquid crystal cells being overlapped by the red, green and blue color filters, respectively, applying a second driving signal to a second liquid crystal cell during a partial period of the one frame interval, the second liquid crystal cell being overlapped by the white color filter, and applying a third driving signal different from the second driving signal to the second liquid crystal cell during a remaining period of the one frame interval.

In another aspect, the method of driving a liquid crystal display, which includes a color filter array having a plurality of red, green, blue and white color filters, includes applying first driving signals to first liquid crystal cells during a first half of one frame interval, the first liquid crystal cells being overlapped by the red, green, blue and white color filters, respectively, applying a second driving signal to a second liquid crystal cell during a partial period of the one frame interval, the second liquid crystal cell being overlapped by the white color filter, and applying a third driving signal different from the second driving signal to the second liquid crystal cell during a remaining period of the one frame interval.

In another aspect, the driving apparatus for a liquid crystal display includes a color filter array having a plurality of red, green, blue and white color filters, a liquid crystal display panel including a plurality of liquid crystal cells being overlapped by the plurality of red, green, blue and white color filters, and a back light part including a plurality of cold cathode fluorescent lamps for applying a white light to the liquid crystal display panel, and at least another light source provided between the cold cathode fluorescent lamps to apply light of a color other than white.

In another aspect, the method of driving a liquid crystal display, which includes a color filter array having a plurality of red, green, blue and white color filters, includes applying first driving signals to first liquid crystal cells and a second liquid cell during a first half of one frame interval, the first liquid crystal cells being overlapped by the red, green, blue color filters, respectively, and the second liquid crystal cell being overlapped by the white color filter, applying a second driving signal to second liquid crystal cell during a partial period of the one frame interval, and applying a third driving signal different from the second driving signal to the second liquid crystal cell during a remaining period of the one frame interval.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 1:
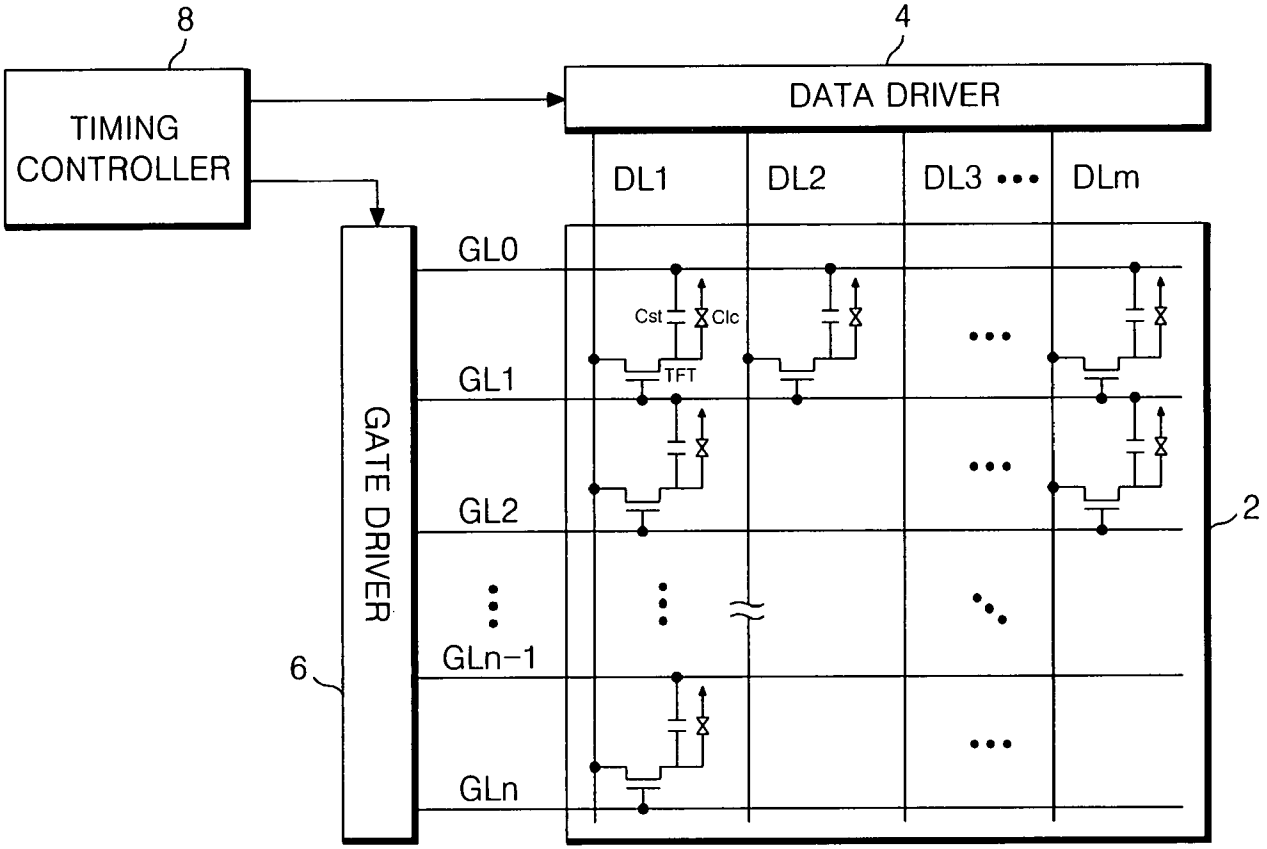
FIG. 1 RELATED ART
FIG. 1 is a schematic block diagram of a configuration of a driving apparatus for a liquid crystal display according to related art.
Figure 2:
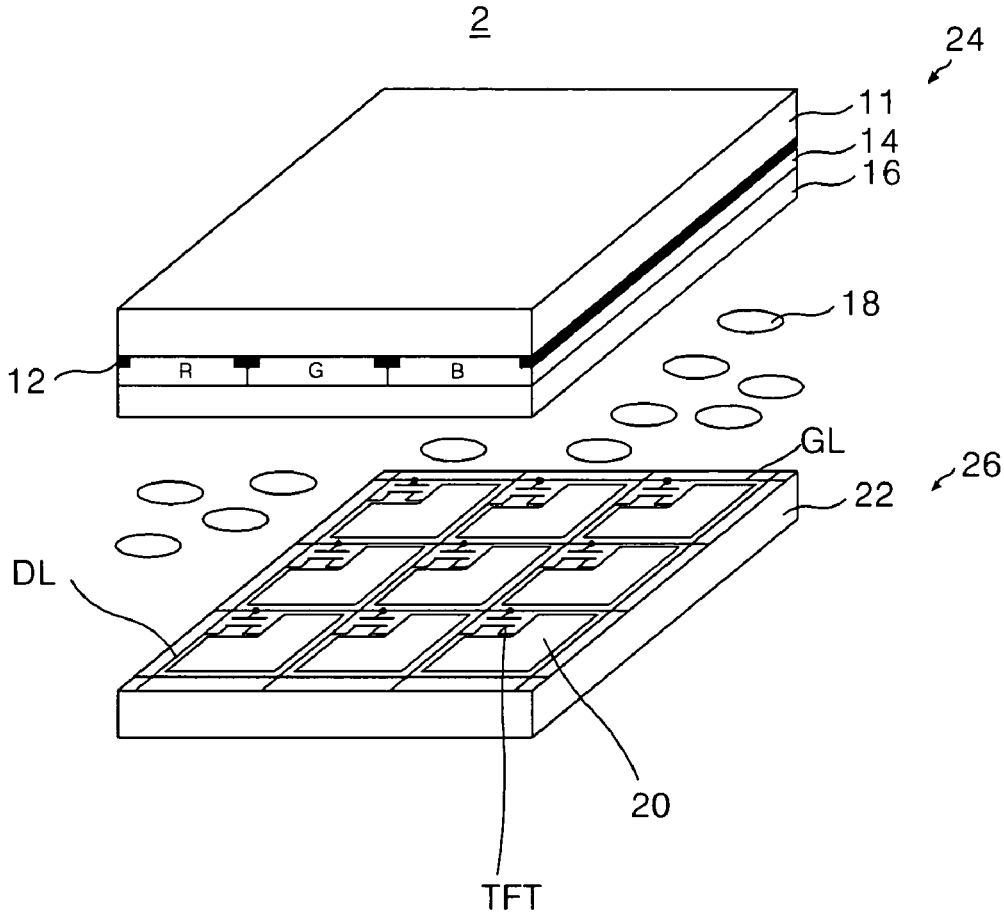
FIG. 2 RELATED ART
FIG. 2 is a detailed perspective view of the liquid crystal display panel shown in FIG. 1.
Figure 3:
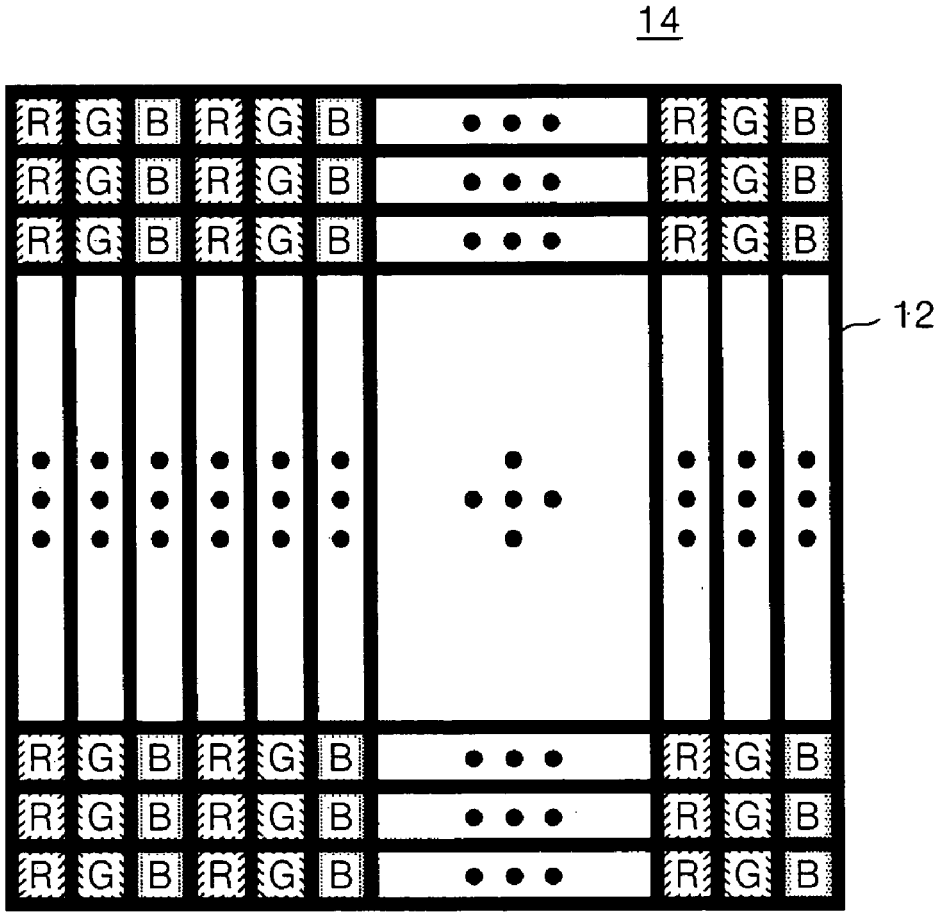
FIG. 3 RELATED ART
FIG. 3 depicts the color filter array shown in FIG. 1.
Figure 4:
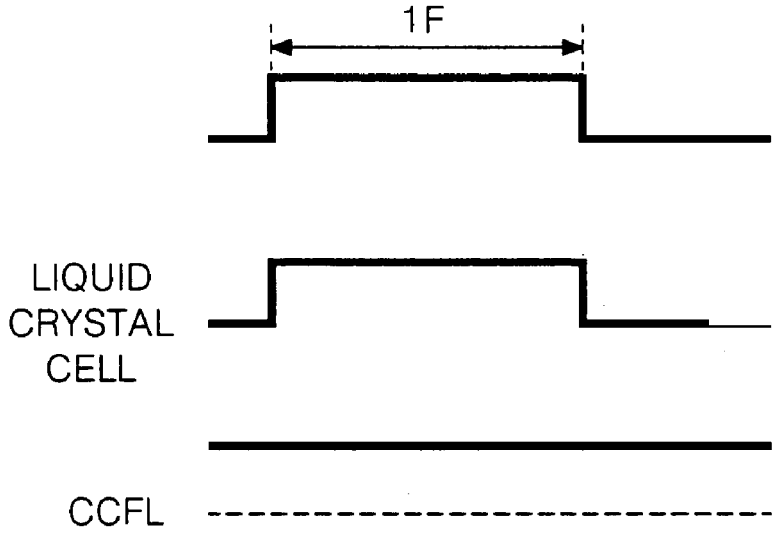
FIG. 4 RELATED ART
FIG. 4 represents a driving process of the liquid crystal cell shown in FIG. 1.
Figure 5:
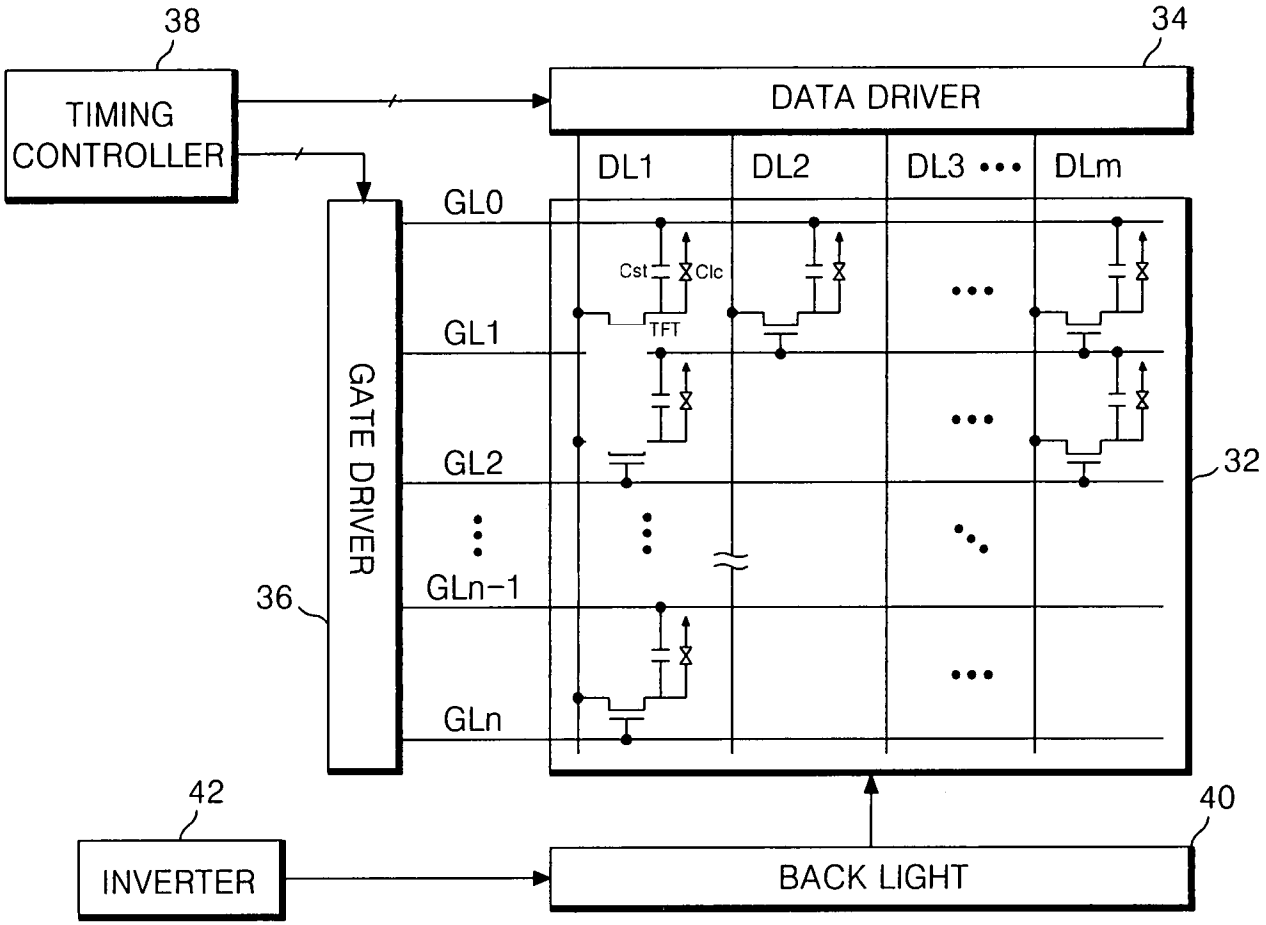
FIG. 5 is a schematic block diagram of a configuration of an exemplary driving apparatus for a liquid crystal display according to an embodiment of the present invention.

FIG. 5 is a schematic block diagram of a configuration of an exemplary driving apparatus for a liquid crystal display (LCD) according to an embodiment of the present invention. Referring to FIG. 5, the LCD includes a liquid crystal display panel 32, a data driver 34 for driving data lines DL1 to DLm of the liquid crystal display panel 32, a gate driver 36 for driving gate lines GL1 to GLn of the liquid crystal display panel 32, a timing controller 38 for controlling driving timing of the data and gate drivers 34 and 36, a back light part 40 having a plurality of back lights that overlaps the liquid crystal display panel 32, and an inverter 42 for controlling the back light part 40.

The timing controller 38 generates controls signals and applies the generated control signals to the data driver 34 and the gate driver 36. The gate driver 36 sequentially applies a gate signal to the gate lines GL1 to GLn under control of the timing controller 38. The data driver 34 converts R, G and B data from the timing controller 38 into analog data signals. The data driver 34 applies the analog data signals corresponding to each horizontal line to the data lines DL1 to DLm whenever the gate signal is supplied to the gate lines GL1 to GLn.

The liquid crystal display panel 32 includes thin film transistors TFT provided adjacent to crossings of an n number of gate lines GL1 to GLn and an m number of data lines DL1 to DLm. The liquid crystal display panel also includes liquid crystal cells connected to the thin film transistors TFT and in a matrix arrangement.

Each thin film transistor TFT applies a data from one of the data lines DL1 to DLm to a liquid crystal cell in response to a gate signal from one of the gate lines GL1 to GLn. The liquid crystal cell comprises a common electrode and a pixel electrode. The pixel electrode is connected to the thin film transistor TFT. The common electrode is opposite the pixel electrode. A liquid crystal is disposed between the common electrode and the pixel electrode. Thus, the liquid crystal cell can be equivalently expressed as a liquid crystal capacitor Clc.

Figure 6:
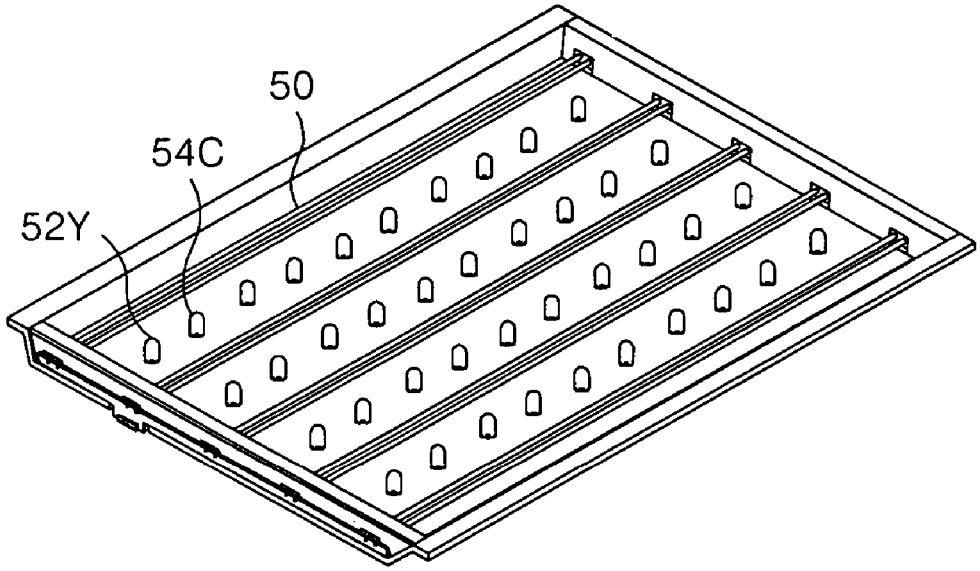
FIG. 6 is a detailed view of the exemplary back light part shown in FIG. 5.

FIG. 6 is a detailed view of the exemplary back light part shown in FIG. 5. As depicted in FIG. 6. The back light part 40 includes cold cathode fluorescent lamps (CCFL) 50 for emitting white light, and light emitting diodes 52Y and 54C provided between the cold cathode fluorescent lamps 50. In this case, the light emitting diodes 52Y and 54C comprise of a yellow light source 52Y for emitting a yellow color, and a cyan light source 54C for emitting a blue-green color. The yellow light source 52Y and the cyan light source 54C are alternately arranged between the cold cathode fluorescent lamps 50. The inverter 42 controls the cold cathode fluorescent lamps 50, the yellow light source 52Y and the cyan light source 54C such that a white light, a yellow light and a blue-green light can be emitted during desired periods. Herein, the periods when the white light, the yellow light and the blue-green light are supplied, etc. will be described later.

Figure 7A:
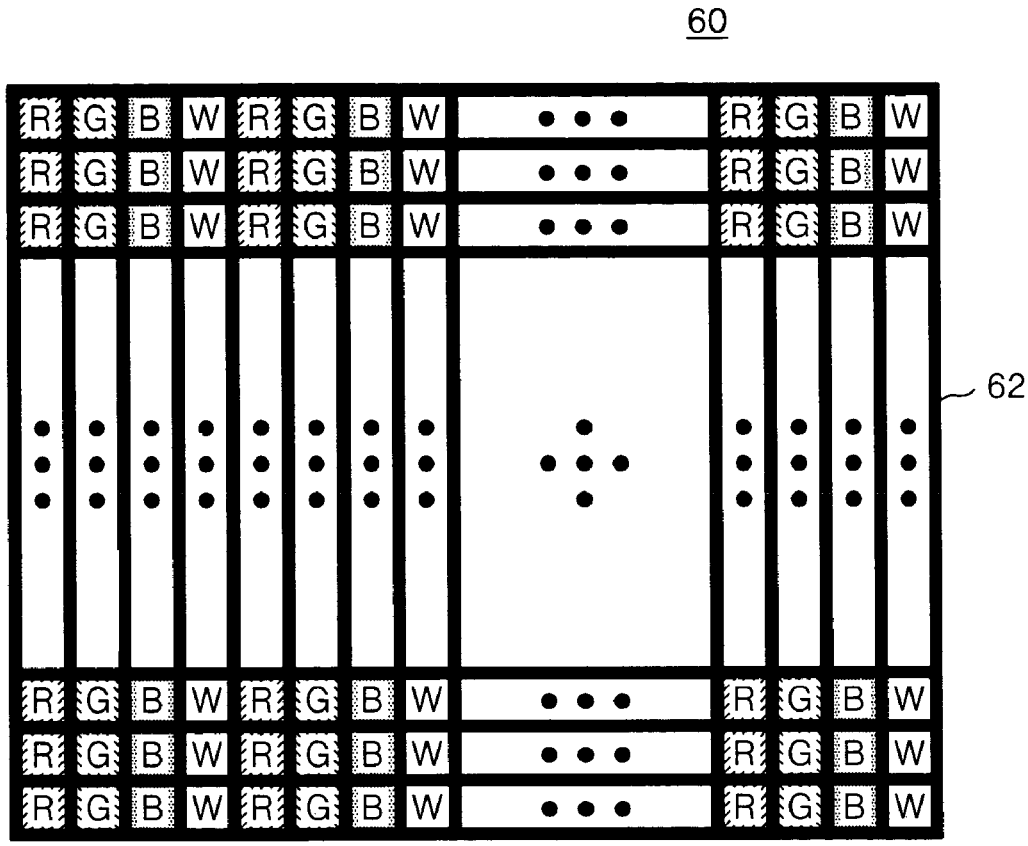
FIG. 7A and FIG. 7B depict the exemplary color filter array shown in FIG. 5.
Figure 7B:
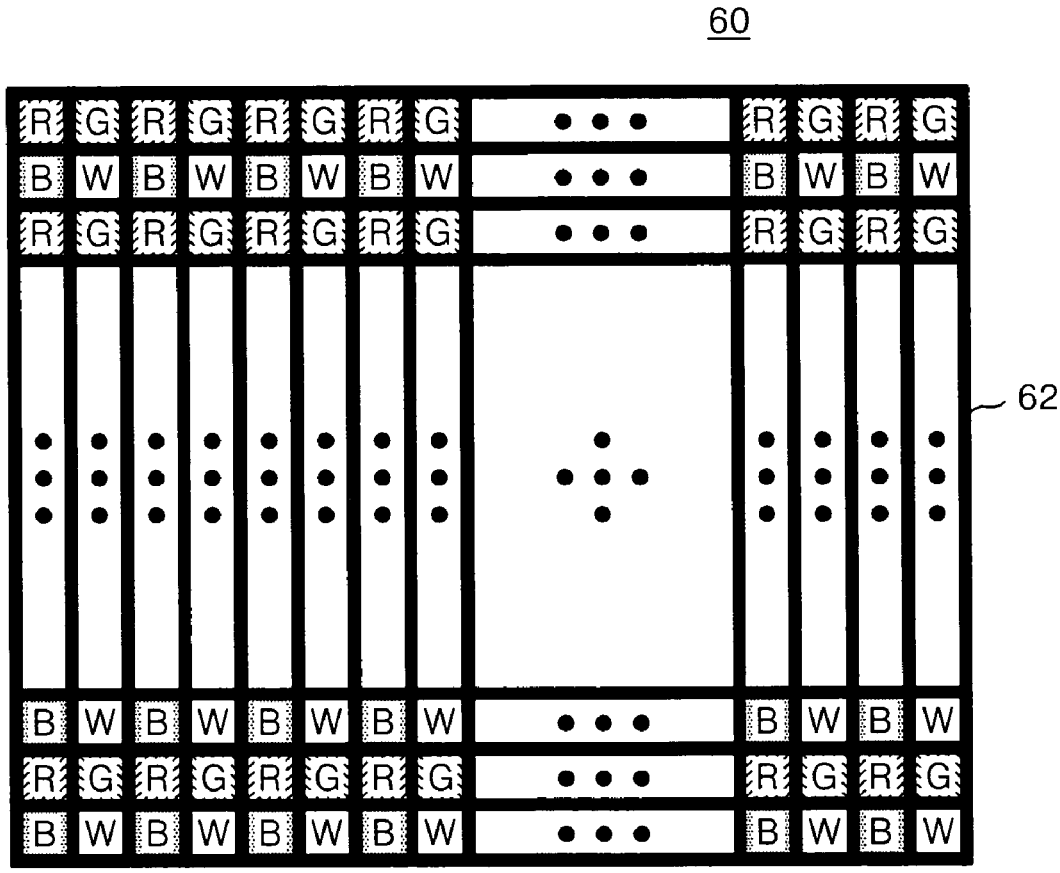

FIG. 7A and FIG. 7B depict the exemplary color filter array shown in FIG. 5. The color filter array according to an embodiment of the present invention is configured as shown in FIG. 7A. In other words, the color filter array 60 includes a plurality of red (R), green (G), blue (B) and white (W) color filters that are sequentially along each horizontal line. The red (R) color filter transmits light within a specific band of wavelengths such that the transmitted light has a red color. The green (G) color filter transmits light within a specific band of wavelengths such that the transmitted light has a green color. The blue (B) color filter transmits light within a specific band of wavelengths such that the transmitted light has a blue color. The white (W) color filter transmits a light applied thereto without changing the color. To this end, the white (W) color filter is implemented as an open window. Alternatively, the white (W) color filter can be made of a transparent material. Such R, G, B and W color filters are provided for each liquid crystal cell. The R, G and B color filters change light color into red, green and blue, respectively, while the W color filter transmits light unchanged, thereby displaying a desired color picture.

Further, the color filter array 60 includes a black matrix 62 positioned among the R, G, B and W color filters. The black matrix 62 encloses the R, G, B and W color filters to absorb light emitted by adjacent light sources, thereby preventing contrast degradation.

Meanwhile, the red (R), green (G), blue (B) and white (W) color filters in the color filter array 60 can be arranged according to various patterns. For example, as shown in FIG. 7B, the red (R) and green (G) color filters are alternately arranged at the odd-numbered horizontal lines of the color filter array 60 while the blue (B) and white (W) color filters are alternately arranged at the even-numbered horizontal lines of the color filter array 60. Alternatively, the red (R) and green (G) color filters can be alternately arranged at the even-numbered horizontal lines of the color filter array 60 while the blue (B) and white (W) color filters are alternately arranged at odd-numbered horizontal lines of the color filter array 60.

Figure 8:
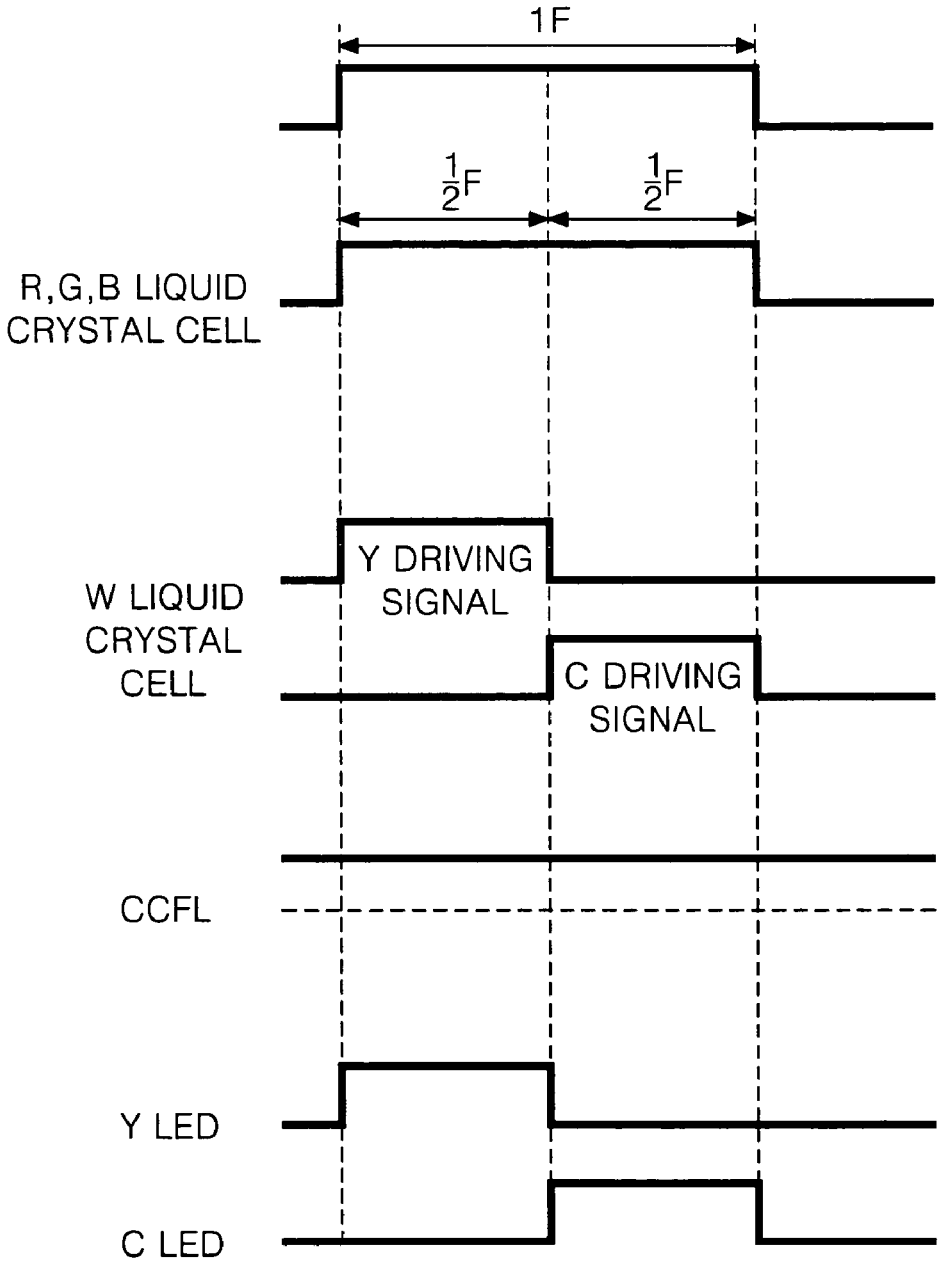
FIG. 8 represents an exemplary method of driving a liquid crystal display according to an embodiment of the present invention.

FIG. 8 represents an exemplary method of driving a liquid crystal display according to an embodiment of the present invention. Referring to FIG. 8, the inverter 42 turns on the cold cathode fluorescent lamps (CCFL) 50 during one frame interval 1F and applies a white light to the liquid crystal display panel 32. Further, the inverter 42 turns on the yellow light source (Y LED) 52Y during the first half of the one frame interval 1F and applies a yellow light to the liquid crystal display panel 32. The inverter 42 turns on the cyan light source (C LED) 54C during the second half thereof and applies a blue-green light to the liquid crystal display panel 32.

The liquid R, G and B crystal cells, which are respectively overlapped by the red (R), green (G) and blue (B) color filters, receive driving signals (i.e., a data signals) during one frame interval 1F. Then, a desired color picture corresponding to the driving signals (i.e., data signals) is displayed through the red (R), green (G) and blue (B) color filters.

During the first half of one frame interval 1F, driving signals corresponding to a yellow color are applied to the W liquid crystal cell, which is overlapped by the white (W) color filter. Then, a yellow light is applied through the white (W) color filter during the first half of one frame interval 1F. In other words, the yellow light source (Y LED) 52Y is turned on. Further, during the second half of one frame interval 1F, driving signals corresponding to a blue-green color is applied to the W liquid crystal cell. Accordingly, a blue-green light is applied through the white (W) color filter during the second half of one frame interval 1F. In other words, the cyan light source (C LED) 54C is turned on.

In accordance with the above-mentioned embodiment of the present invention, lights from the yellow light source 52Y and the cyan light source 54C are applied through the white (W) color filter, thereby driving the liquid crystal display panel 32 with red, green, blue, yellow and blue-green color lights. Accordingly, it becomes possible to achieve more vivid colors than the related art. The white (W) color filter can made of a transparent material or implemented through a transparent window, so that it becomes possible to obtain a higher transmittance and improved brightness in comparison with the related art.

Figure 9:
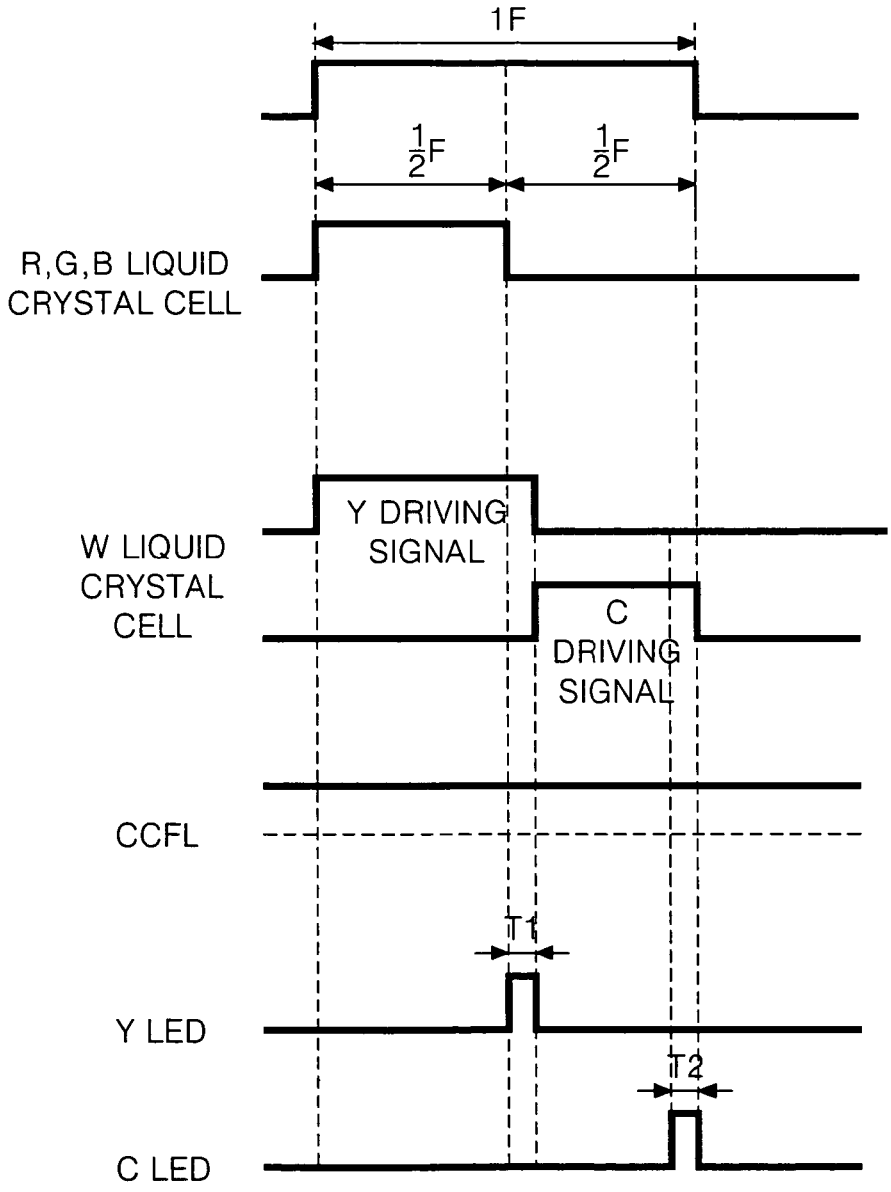
FIG. 9 represents an exemplary method of driving a liquid crystal display according to another embodiment of the present invention.

FIG. 9 represents an exemplary method of driving a liquid crystal display according to another embodiment of the present invention. According to another embodiment of the present invention, the cyan light source 54C is turned on during the first half of one frame interval, as shown in FIG. 9. Driving signals corresponding to a blue-green color are applied to the white liquid crystal cells. The yellow light source 52Y is turned on during the second half of one frame interval and driving signals corresponding to a yellow color are applied to the white liquid crystal cells.

As further shown in FIG. 9, the inverter 42 turns on the cold cathode fluorescent lamps (CCFL) 50 during one frame interval 1F and applies a white light to the liquid crystal display panel 32. The inverter 42 turns on the yellow light source (Y LED) 52Y during the initial period T1 of the second half of the one frame interval 1F to apply a yellow light to the liquid crystal display panel 32 during the initial period T1. The inverter 42 turns on the cyan light source (C LED) 54C during the last period T2 of the second half thereof to apply a blue-green light to the liquid crystal display panel 32. Herein, the T1 and T2 periods are set equally to a duration of approximately 1 ms to 3 ms.

Figure 10A:
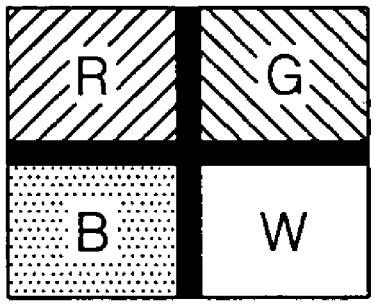
FIG. 10A to FIG. 10D depict exemplary lights emitted by the driving method shown in FIG. 9.

FIG. 10A to FIG. 10D depict exemplary lights emitted by the driving method shown in FIG. 9. During the first half of one frame interval 1F, driving signals are applied to the R, G and B liquid crystal cells, which are respectively overlapped by the red (R), green (G) and blue (B) color filters. Then, as shown in FIG. 10A, a desired color picture corresponding to driving signals (i.e., data signals) is displayed through the red (R), green (G) and blue (B) color filters. Further, during the first half of one frame interval 1F, driving signals corresponding to a yellow color are applied to the W liquid crystal cell, which is overlapped by the white (W) color filter. Since the yellow light source 52Y and the cyan light source 54C are turned off during that period, a white light is emitted through the white (W) color filter.

Figure 10B:
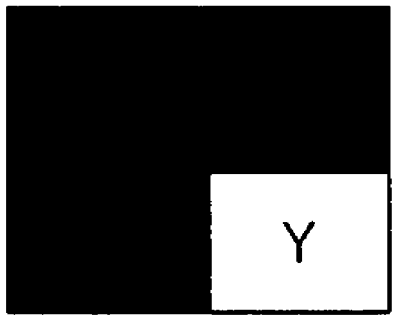

During the initial period T1 of the second half of one frame interval 1F, driving signals corresponding to a yellow color are applied to the W liquid crystal cell. In other words, yellow driving signals are applied during the first half and the initial period T1 of the second half frame. Since the yellow light source 52Y is turned on during that period, a white light is emitted through the white color filter W during the initial period T1 of the second half frame as shown in FIG. 10B. On the other hand, since driving signals are not applied to the R, G and B liquid crystal cells, which are overlapped by the red (R), green (G) and blue (B) color filters, respectively, a black color is displayed during the second half of one frame interval 1F.

Figure 10C:
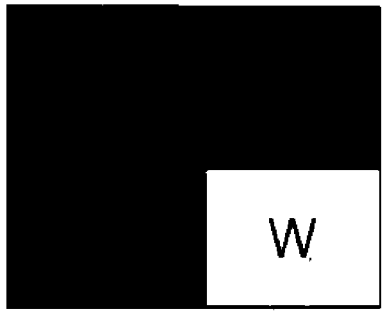
Figure 10D:
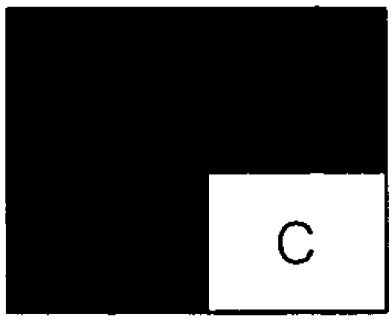

Thereafter, during the remaining period other than the initial period T1 of the second half of one frame interval 1F, driving signals corresponding to a blue-green color are applied to the W liquid crystal cell, which is overlapped by the white (W) color filter. Since the yellow light source 52Y and the cyan light source 54C have been turned off during that period, a white light is emitted through the white (W) color filter as shown in FIG. 10C. Further, since the cyan light source 54C is turned on during the last period T2 of the second half of one frame interval 1F, a blue-green light is emitted through the white (W) color filter as shown in FIG. 10D.

In the above-discussed embodiment of the present invention, lights from the yellow light source 52Y and the cyan light source 54C are transmitted through the white (W) color filter, thereby driving the liquid crystal display panel 32 with red, green, blue, yellow and blue-green color lights. Accordingly, more vivid color can be achieved than with the related art. The white (W) color filter can be made of a transparent material or implemented with a transparent window. Thus, a higher transmittance and improved brightness can be achieved in comparison with the related art. Moreover, color interference can be prevented because there is no a time when yellow and blue-green lights are emitted from the white (W) color filter simultaneously with lights from the red (R), green (G) and blue (B) color filters.

Alternatively, in yet another embodiment of the present invention, blue-green driving signals may be applied during the initial period T1 of the first half of one frame interval 1F and the cyan light source 54C may be turned on during the first half thereof. Then, yellow driving signals are applied during the remaining period of one frame interval. Accordingly, the yellow light source 52Y is turned on during the last period T2 of the second half of one frame interval.

In another embodiment of the present invention, any one of the yellow light source 52Y and the cyan light source 52C may be replaced by a magenta light source.

As described above, according to the present invention, yellow, cyan and white light sources and red, green, blue and white color filters are provided to emit red, green, blue, white and blue-green color lights, and mixtures thereof, from the liquid crystal display panel, thereby displaying more vivid colors. Furthermore, the white color filter can be made of a transparent material or implemented through a transparent window, so that a higher transmittance and an improved brightness can be achieved in comparison with the related art.

It will be apparent to those skilled in the art that various modifications and variations can be made in embodiments the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display including a color filter array having a plurality of red, green, blue and white color filters, comprising:

applying first driving signals to first liquid crystal cells during a first half of one frame interval, the first liquid crystal cells being overlapped by the red, green, and blue color filters, respectively;

applying a second driving signal to a second liquid crystal cell during a partial period of the one frame interval, the second liquid crystal cell being overlapped by the white color filter; and applying a third driving signal different from the second driving signal to the second liquid crystal cell being overlapped by the white color filter during a remaining period of the one frame interval, wherein the first driving signal is applied during the first half of the one frame interval and during a first period of a second half of the one frame interval, wherein a yellow light is applied to the second liquid crystal cell during the first period, and wherein applying the second driving signal includes applying a cyan light during a second period equal in duration to the first period.

2. The method of claim 1, wherein a white light is applied to the first and second liquid crystal cells during the one frame interval.

3. The method of claim 1, wherein each of the first and second periods is set to a range of 1 ms to 3 ms.

4. The method of claim 1, wherein a cyan light is applied to the second liquid crystal cell during the first period, and wherein applying the second driving signal includes applying a yellow light during a second period equal in duration to the first period.

5. The method of claim 1, wherein applying the second driving signal includes applying a yellow light to the second liquid crystal cell during the first period, and applying the third driving signal includes applying a magenta light to the second liquid crystal cell during a second period of the second half of the one frame interval, the second period being equal in duration to the first period.

6. The method of claim 1, wherein applying the second driving signal includes applying a magenta light to the second liquid crystal cell during the first period, and applying the third driving signal includes applying a cyan light to the second liquid crystal cell during a second period of the second half of the one frame interval, the second period being equal in duration to the first period.

7. The method of claim 1, wherein applying the second driving signal includes applying a cyan light to the second liquid crystal cell during the first period, and applying the third driving signal includes applying a magenta light to the second liquid crystal cell during a second period of the second half of the one frame interval, the second period being equal in duration to the first period.

* * * * *